US006206601B1

(12) United States Patent
Ko

(10) Patent No.: US 6,206,601 B1
(45) Date of Patent: Mar. 27, 2001

(54) LOCKING BOOSTER RING BINDER MECHANISM

(75) Inventor: Chung Nin Ko, Kowloon (HK)

(73) Assignee: Hong Kong Stationery Manufacturing Co., Ltd., Kowloon (HK)

( * ) Notice: Subject to any disclaimer, the term of this patent is extended or adjusted under 35 U.S.C. 154(b) by 0 days.

(21) Appl. No.: 09/262,307

(22) Filed: Mar. 4, 1999

(51) Int. Cl.[7] ..... B42F 13/26
(52) U.S. Cl. ..... 402/38; 402/41
(58) Field of Search ..... 402/26, 31, 36–42, 402/70, 73

(56) References Cited

U.S. PATENT DOCUMENTS

| | | | | |
|---|---|---|---|---|
| 1,787,956 | | 1/1931 | Schade . | |
| 1,841,793 | | 1/1932 | Dawson . | |
| 1,868,793 | | 7/1932 | Dawson . | |
| 1,896,838 | | 2/1933 | Dawson . | |
| 1,896,839 | | 2/1933 | Dawson . | |
| 1,913,700 | | 6/1933 | Dawson . | |
| 1,927,113 | | 9/1933 | Dawson . | |
| 2,013,552 | | 9/1935 | Dawson . | |
| 2,041,168 | | 5/1936 | Dawson . | |
| 2,061,676 | | 11/1936 | Schade . | |
| 2,105,235 | | 1/1938 | Schade . | |
| 2,498,902 | | 2/1950 | Segal . | |
| 2,950,719 | | 8/1960 | Lyon . | |
| 3,077,388 | | 2/1963 | Elrick et al. . | |
| 3,098,490 | | 7/1963 | Wance . | |
| 3,101,719 | | 8/1963 | Vernon . | |
| 3,884,586 | * | 5/1975 | Michaelis et al. | 402/38 |
| 4,566,817 | | 1/1986 | Barrett, Jr. . | |
| 4,813,803 | * | 3/1989 | Gross | 402/38 |
| 5,067,840 | * | 11/1991 | Cooper et al. | 402/38 |
| 5,116,157 | * | 5/1992 | Gillum et al. | 402/38 |
| 5,135,323 | | 8/1992 | Pinheiro . | |
| 5,180,247 | | 1/1993 | Yu . | |
| 5,255,991 | | 10/1993 | Sparkes . | |
| 5,354,142 | | 10/1994 | Yu . | |
| 5,393,155 | * | 2/1995 | Ng | 402/31 |

* cited by examiner

*Primary Examiner*—Stephen F. Gerrity
(74) *Attorney, Agent, or Firm*—Shoemaker and Mattare, Ltd.

(57) ABSTRACT

A loose-leaf binder mechanism has a housing containing a pair of pivotally mounted hinge plates each carrying a series of spaced prongs. The hinge plates toggle between open and closed positions under the control of an actuating lever. One portion of the lever is selectively moveable into a wedged-in position between the housing and hinge plates to lock the prongs in closed position. The lever is specially constructed so that it can be moved while wedged between the housing and hinge plates to a safety locking position such that any point of contact between the lever portion and the housing is advantageously disposed longitudinally inward of any point of contact between said one portion and the hinge plates, and so that it cannot be moved inward past the safety-lock position out of the wedged-in configuration between the housing and hinge plates.

3 Claims, 6 Drawing Sheets

DETAIL X

LOCKING BOOSTER RING BINDER MECHANISM

BACKGROUND OF THE INVENTION

This invention relates generally to loose-leaf binder mechanism of the type which are commonly used in ring binders.

Ring binders include an elongated housing containing a pair of pivoting elongated hinge plates each of which carries a series of spaced apart prongs. Each prong on one hinge plate is aligned with a prong on the other hinge plate. The hinge plate may be pivoted relative to each other between two positions. In one of these positions the aligned prongs engage each other to form a closed loose-leaf sheet retaining loop; and in the other position each pair of aligned prongs is spread apart to permit removal or insertion of loose-leaf sheets. While the prongs can be used as levers to move the hinge plates between the two positions, such binders commonly include separate lever-type actuating means for pivoting the hinge plates between the open and closed position as exemplified in the U.S. Pat. Nos.

1,787,956, 1,841,793, 1,868,793, 1,896,838, 1,896,839, 1,913,700, 1,927,113, 2,013,552 2,041,168, 2,498,902, 3,101,719, and 3,884,586.

One problem associated with loose-leaf binders of the type described is the possibility that the prongs may be accidentally opened during use. This may happen, for example, if one drops a filled binder causing the hinge plates to open. In situations where the binder is stored in an inverted position with the loose-leaf sheets suspended or hanging from the loop defined by the closed prongs, the weight of the loose-leaf sheets may tend to pry the prongs apart, and in some housings may even cause complete opening of the prongs. To prevent accidental or otherwise unintentional opening of the prongs, a means for locking the prongs in closed position is required. Many known loose-leaf ring binders have been constructed with various forms of locking means as exemplified by the U.S. Pat. Nos. 2,061,676, 2,105,235, 2,950,719, 3,077,388, 3,098,490 and 3,884,586. The most pertinent of these, relative to this invention, is U.S. Pat. No. 3,098,490 which provides a construction where a portion of an actuating lever is wedged between the hinge plates and the housing to lock the prongs together.

SUMMARY OF THE INVENTION

An object of the present invention is to construct a relatively inexpensive, reliable and easy-to-use locking ring binder mechanism.

This effort has successfully resulted in a novel and improved ring binder mechanism which, in addition to combining the locking and actuating functions in a lever-type actuator also combines a unique safety lock feature in the lever-type actuator to prevent accidental release of the lock.

This invention provides an improved locking ring binder mechanism which is exceedingly simple in construction, with very few moving parts, is easy and relatively inexpensive to manufacture and assemble, and is reliable in operation.

As in conventional ring binders, the binder of this invention includes an elongated housing or cover within which a pair of robust elongated hinge plates are pivotally mounted with the pivot axis of each extending longitudinally along its outer edge; the inner edges of the hinge plates are disposed in abutting relationship. Each hinge plate, as in known constructions, carries a series of longitudinally spaced apart prongs with each prong on one hinge plate being aligned with a prong on the other hinge plate. The hinge plates are selectively moveable between an inwardly bowed position and an outwardly bowed position. In the inwardly bowed position, the hinge plates extend inwardly of the housing with their surfaces mounting the prongs facing away from each other, each pair of aligned prongs being thus spread apart to permit insertion and removal of loose-leaf sheets. In the outwardly bowed position the hinge plates extend outwardly of the housing with their prong mounting or carrying surfaces facing each other; each pair of aligned prongs thus engage each other to define a closed loose-leaf sheet retaining loop. Finally, an actuating means is provided for moving the hinge plates between the two described positions.

An advantage of this invention is the robustness and reliability of the actuating means. According to this invention, the actuating means comprises a pivoting lever member engaging the hinge plates, hinge plate depressor means responsive to movement of the lever for moving the hinge plates from the inwardly to outwardly bowed position, and hinge plate lifting means also responsive to movement of the lever for moving the hinge plate from the outwardly bowed position to the inwardly bowed position. The lever is, more particularly, operable upon being pivoted in one direction through one predetermined locus of its path of movement to apply an outwardly directed force on the inwardly bowed hinge plates with enough leverage to move them through their coplanar position of the hinge plates to the outwardly bowed position. Upon pivoting of the lever in the reverse direction, the lever applies an inwardly directed force to the outwardly bowed hinge plates sufficient enough to move the outwardly bowed hinge plates through the coplanar position back to the inwardly bowed position. The lever is so constructed that a portion of it can, as the lever is moved over a range of angular positions disposed along another segment its path of movement, be selectively wedged tightly between the outwardly bowed hinge plates and the housing to lock the prongs in closed position.

Within the range of wedged-in positions, the lever can be moved between a first position such that an imaginary line interconnecting any point of contact between the wedged-in portion of the lever and the housing with any point of contact between the wedged-in portion of the lever and the hinge plates is oriented at an upwardly inclined outwardly extending attitude relative to the housing and a second position such that said imaginary line is oriented at an upwardly inclined inwardly extending attitude relative to the housing.

Finally, the improved actuating means of this invention includes a stop lock means for preventing inward pivotal movement of the lever to any position beyond said second position where its wedging portion would cease to be wedged between the housing and outwardly bowed hinge plates.

With the construction described, the hinge plates are locked in the outwardly bowed position, the aligned prongs being thereby locked in closed position, at all lever positions where its wedging portion is wedged between the housing and outwardly bowed hinge plates. And, importantly, by moving the lever from said first wedged-in position described above past the center wedged-in position into the said second wedged-in position described above, an effective safety for the lock is provided minimizing the chances of the locked prongs becoming accidentally released.

DESCRIPTION OF THE PREFERRED EMBODIMENT

Figure 1:
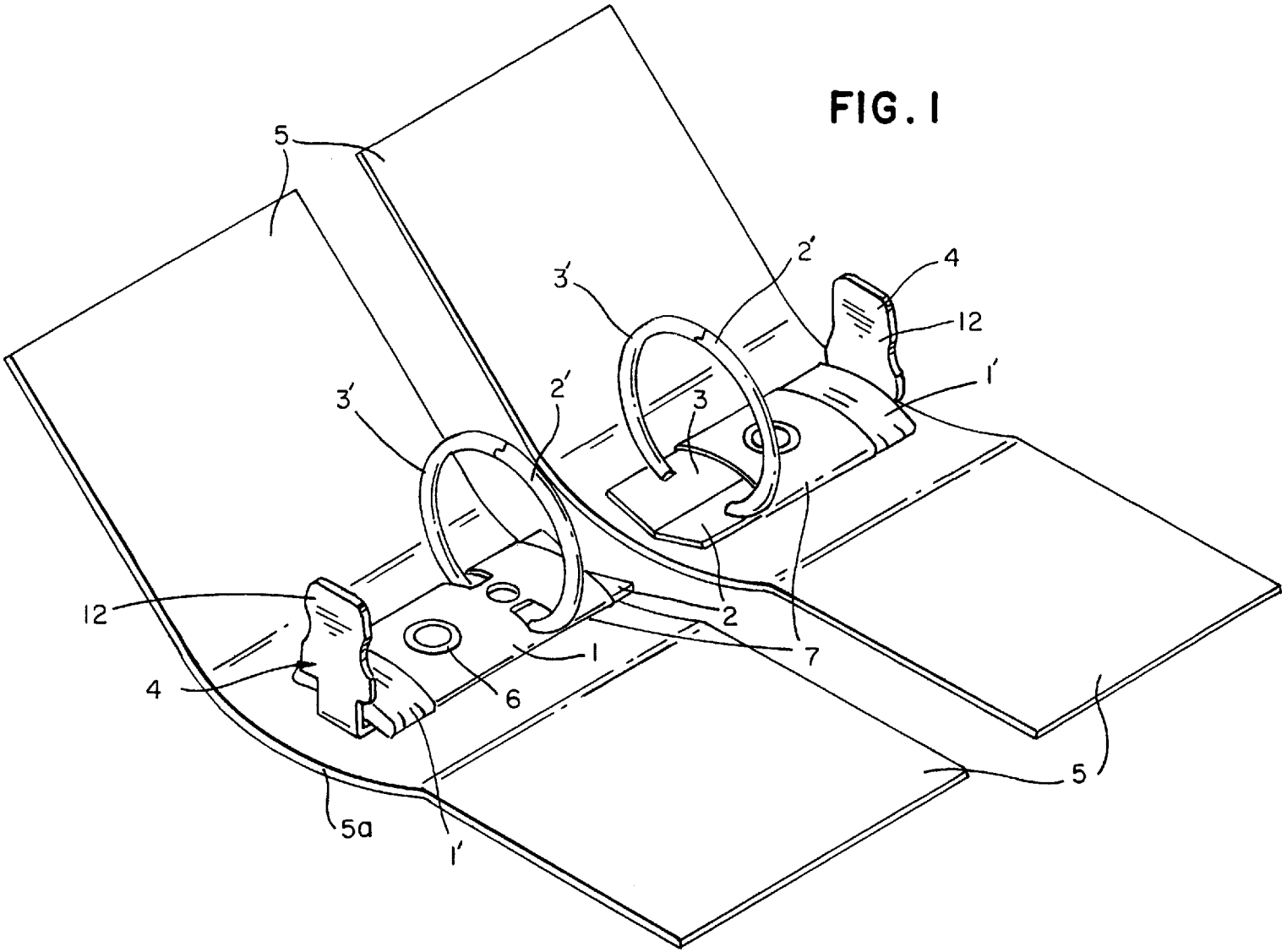
FIG. 1 is a perspective view of a loose-leaf binder equipped with a loose-leaf binder mechanism according to this invention.

With reference to FIG. 1, the loose-leaf binder of this invention includes an elongated housing member 1, a pair of elongated hinge plates 2 and 3 each of which carries a series of prongs 2' and 3', respectively, and actuating lever 4 located at each end of the housing member. In the construction shown, housing 1 and hinge plates 2, 3 are made of a relatively stiff spring-like metal, the purpose of which will become apparent as the description continues. In this invention, additional metallic shells 1' are mounted on both ends of the binder to improve the tightening and endurance of the locking mechanism by adding stiffness and thereby reducing local deformation while the locking is engaged. The housing 1, shells 1' and hinge plates 2, 3 may, however, be made of material other than metal provided it is relatively stiff and exhibits spring characteristics. As shown in FIG. 1, the entire assembly is secured to the spine 5*a* of a typical loose-leaf book cover 5 by means of rivet 6 extending through hinge plates 2, 3 to connect housing 1 and binder cover 5 together.

Housing 1 has a generally arched cross-sectional configuration with the crown of the arch up and with its marginal longitudinal edges 7 being curled under to form elongated hinge pockets 8. Each pocket so formed receives the outer longitudinal edge of one of the hinge plates and generally defines the pivot axis for that hinge plate. The inner longitudinal edges of hinge plates 2 and 3 contacting each other along their entire length as shown; the hinge plates being retained in contact along their inner edges at all angular positions by cleats 6*b* which are formed along the inner longitudinal edge of one hinge plate to overlap the abutting edge of the other hinge plate.

Figure 2:
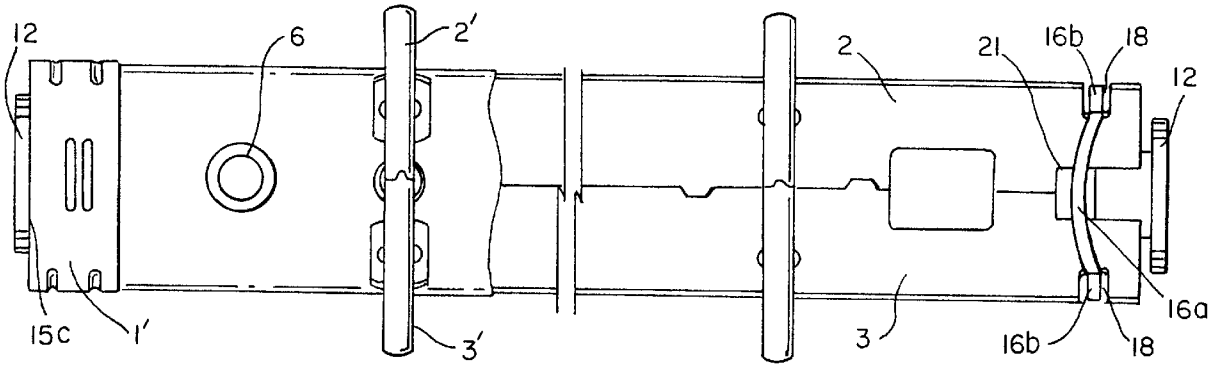
FIG. 2 is a top plan view of the binder mechanism shown in FIG. 1 partially broken away to show the actuating lever in locked position.
Figure 3:
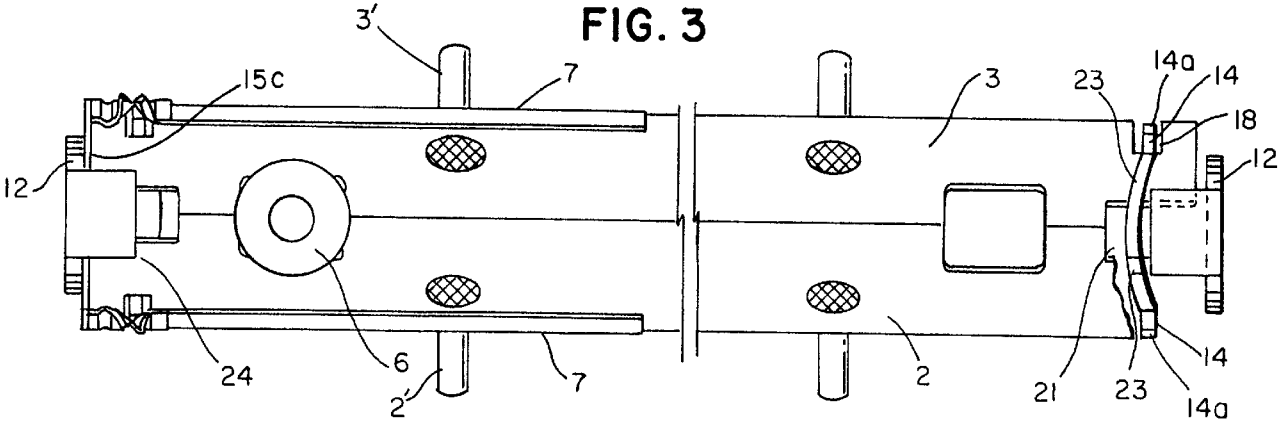
FIG. 3 is a bottom plan view of the binder mechanism shown in FIG. 1 partially broken away to show the actuating lever in its locked position.
Figure 2A:
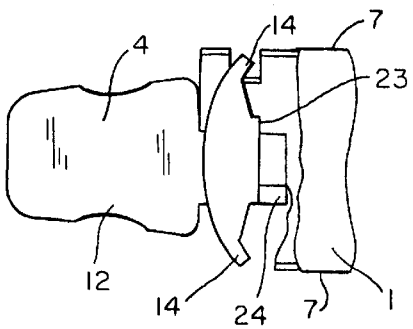
FIG. 2*a* is a view similar to that shown in FIG. 2 but with the actuating lever in an open position.
Figure 3A:
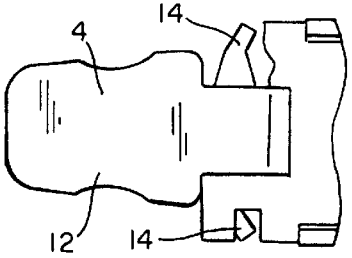
FIG. 3*a* is a view similar to that shown in FIG. 3 but with the actuating lever in its open position.

As can be seen in FIGS. 2 and 3, each prong 2' on hinge plate 2 is aligned with a prong 3' on hinge plate 3. The hinge plates are movable between two positions. One position is shown in FIG. 5*a* wherein hinge plates 2 and 3 are bowed slightly outwardly of housing 1 with their prongs carrying or mounting surfaces facing toward each other. In this position each pair of aligned prongs 2', 3' forms a substantially closed loop or ring for retaining loose-leaf sheets appropriately punched with holes to accept the prongs. The other position of the hinge plates is best seen in FIG. 6*a*. In this position the hinge plates 2, 3 are bowed inwardly of housing 1 with their prong carrying or mounting surfaces facing away from each other; each pair of aligned prongs being thereby spread apart to permit insertion or removal of loose-leaf sheets onto or from the sheet retaining loops.

The combined width of the hinge plates 2,3 is slightly greater than the distance between the pivot axes defined by hinge pockets 8. Movement between the inwardly and outwardly bowed positions occurs without causing disengagement of the inner edges of the hinge plates. That is, the inner edges of the hinge plates remain in contact each other at all angular positions. The hinge plates 2,3 are thus first moved, say, from the outwardly bowed position into a position at which they are disposed in substantially coplanar relationship, the housing flexing or distorting somewhat at this point to accommodate the hinge plates as they move through this coplanar position. The hinge plates then continue into the inwardly bowed position by a snap-through action as the pressure existing at the coplanar position is relieved and the housing assumes a semi-relaxed state. The same actions occur when the hinge plates are moved in the reverse direction from the inwardly bowed position to the outwardly bowed position. Significant pressure must be exerted on the hinge plates to move them through the coplanar position, for example, by the actuating levers presently to be described.

Figure 4:
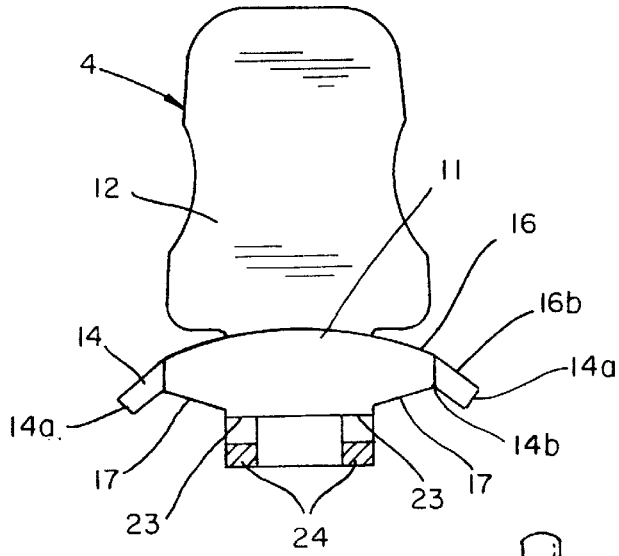
FIG. 4 is an end view of the actuating lever.

The actuating lever is shown in FIG. 4. It includes an actuator portion indicated generally by 11 and a trigger portion indicated by 12. The binding mechanism shown in the drawings includes two such levers positioned at opposite ends of housing 1.

The actuator portion of the lever has a transversely arched body 13 which conforms generally to the arched curvature of housing 1. Body 13 extends in generally parallel offset relationship to trigger 12 in the sense that a plane tangentially disposed to the central portion of body 13 would extend parallel to and spaced from the trigger 12. The upper edge 16 of body 13 is also curved or arched transversely widthwise of housing 1 with a curvature conforming generally to the curvature of arched housing 1. The crown of arched edge 16 of arched body 13 extend generally in perpendicular directions with respect to each other. As shown, retaining member 15 connects the trigger 12 and body 13 together. The retaining member 15 includes two sections 15*a* and 15*b* disposed substantially perpendicular to each other. Section 15*a* is connected at one end to body 13 and at the other end to section 15*b*. As described hereafter, the section 15*a* extends from body 13 longitudinally outward of housing 1 in closely spaced relationship to the under-surface thereof (housing 1 and shell 1') for all locked positions of the lever and the section 15*b* which is situated exteriorly of the housing engages a seating surface 15*c* defined by the end of housing 1 and shell 1' to prevent outward pivotal movement of the lever beyond a full open position. The spacing between the body 13 and the spine is provided to eliminate any possibility of preventing or restricting proper lever movement due to interference between section 15*a* and the spine as the lever is moved from a locked position to an open position. To insure sufficient locking tightness, each end portion of housing 1 is reinforced by a shell 1 ' providing sufficient resistance over the path of movement of the body as the lever is put in the locked position.

Depending from each end of the lower edge 17 of body 13 is a leg element 14 the tip 14*a* of which is bent toward trigger 12. As can be seen in FIG. 3, these leg elements engage notches 18 formed in the outer edges of hinge plates 2, 3. The comers 14*b* between the leg elements 14 and the lower edge 17 contact the hinge plates within notches 18 to define the fulcrum points of the actuating lever for one segment of the path of movement of the lever as explained below.

The lower edge 17 of body 13 carries a centrally located T-shaped lifting element 19 which is bent slightly toward trigger 12. The stem 20 of lifting element 19 extends through an opening 21 defined by a pair of aligned notches formed along the interface between the inner edges of hinge plates 2, 3. From FIGS. 5 and 5*a,* it can be seen that the cross piece 23 of lifting element 19 engages the under-surface of hinge plates 2, 3 at a point which, in order to provide adequate leverage, is located longitudinally inward of the pivot axis of the actuating lever during movement of the hinge plates from the outwardly bowed position to the inwardly bowed position. This pivot axis is defined by an imaginary line extending between the fulcrum points which, as previously mentioned, are defined by the points of contact between comers 14*b* of leg elements 14 and hinge plate notches 18.

The lower edge 17 of body 13 also carries a pair of lug elements 23 which are there to contact the hinge plates during locking. One lug element is located on one side of lifting element 19 at a point located approximately midway between it and the respective leg element on that side of the lifting element; the other lug element being similarly situated on the opposite side of the lifting member. Lug elements 23 engage the upper surface of hinge plates 2 and 3; the points of contact therebetween defining the fulcrum points for the lever for another locus of the path of movement of the lever. The points of contact between lugs 23 and the hinge plates define the lever fulcrum points in moving the hinge plates from their inwardly bowed position to their outwardly bowed position and in locking the hinge plates in their outwardly bowed position.

Figure 6A:
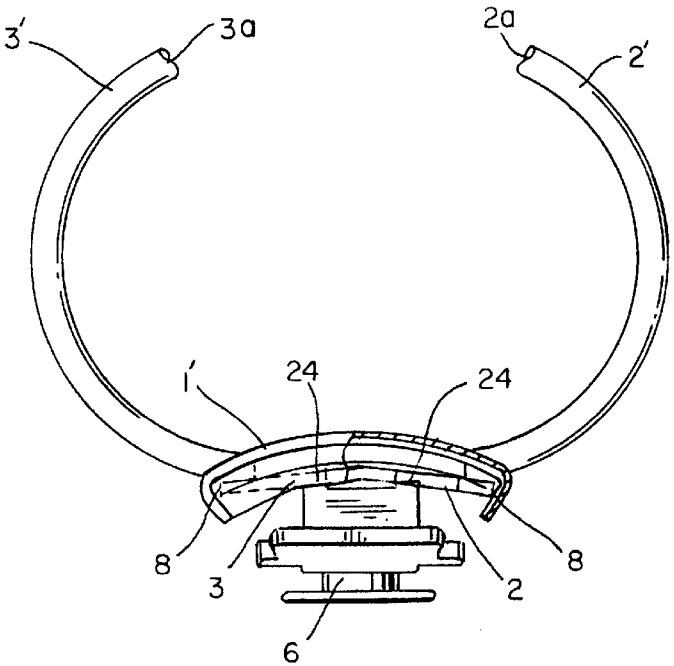
FIG. 6*a* is an end view, partially broken away, of the mechanism shown in FIG. 6.
Figure 6:
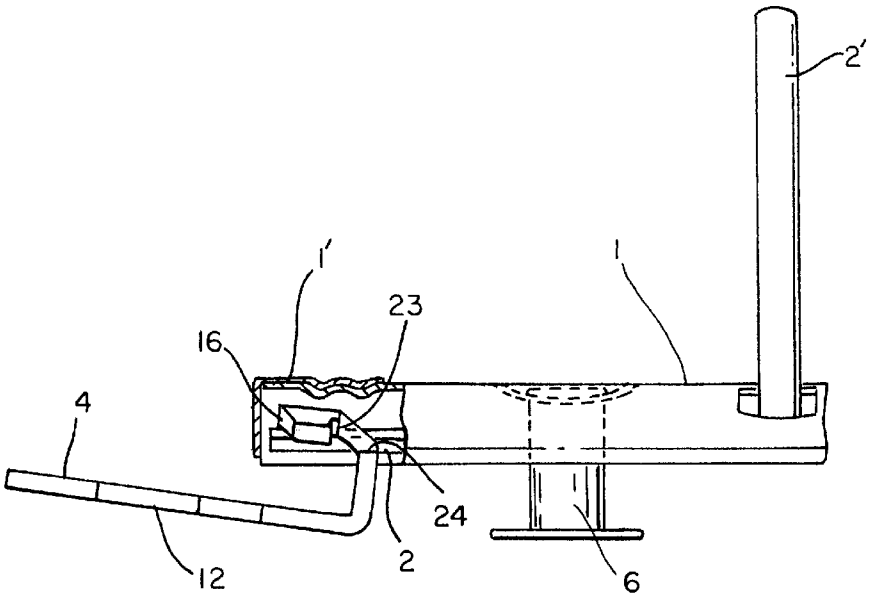
FIG. 6 is a side elevation view of the binder mechanism shown in FIG. 1 partially broken away to show the actuating lever in its open position.

The operation of the binder mechanism can be best described by starting with the hinge plates in their inwardly bowed position as shown in FIGS. 6 and 6*a*. In this position, the aligned prong pairs 2', 3' are spread apart and the arched body 13 of actuator portion 11 of the actuating lever is sandwiched between the inwardly bowed hinge plates and the arched under-surface of the housing with the trigger portion thereof in a generally horizontal position as shown in FIG. 6. Supposing that the required loose-leaf sheets have been earlier removed from or inserted onto the prongs and that it is now desired to close the prongs and lock them in closed position insuring that they will not accidently become separated or opened, the prongs are closed simply by moving the actuating lever in a clockwise direction (as viewed in FIG. 6) until the trigger 12 assumes the 40–50 degree position shown in FIG. 7.

Figure 7:
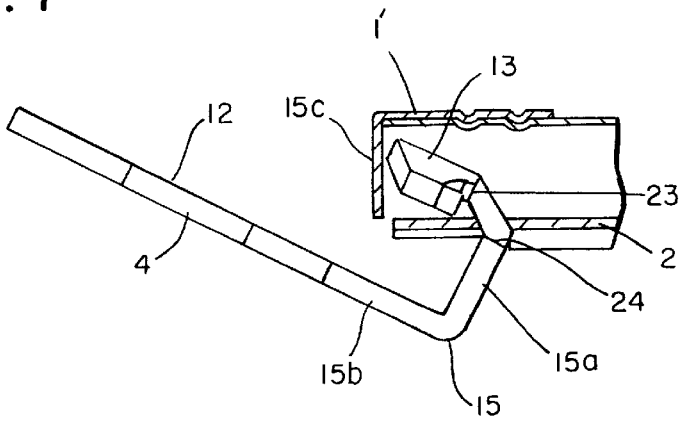
FIGS. 7, 7*a*, 7*b*, 7*c* and 7*d* are cross-sectional views taken along the line 7—7 in FIG. 2*a* showing the actuating lever in the unlocked but closed position, the before-center locked position, the center locked position and the past-center safety locked position, respectively.

During movement of the trigger from the horizontal position to the 40–50 degree position, the body 13 of the actuator portion of the actuating lever is forcibly pivoted inside the housing with its upper surface 16 touching the under-surface of the housing strengthened under the shell, and with the lugs 23 engaging the hinge plates. The pivot axis of the lever during this movement is defined by an imaginary line extending through the points of contact between lugs 24 and the hinge plates. This movement of the actuating lever forces the hinge plates to pivot downward through a position where they are disposed in substantially coplanar configuration. The hinge plates are subjected to significant compressive stress at the coplanar position causing slight but significant flexure or distortion of the housing 1 as was previously mentioned. This is where the shell reinforcement comes into action to control the housing deformation to ensure tight locking. The compressive stress is released as the hinge plates move through the coplanar position whereafter the hinge plates pivot with a snap-through action sharply outward under the force exerted by the housing and the shell returns to a semi relaxed stage. The hinge plates are stopped in their outwardly bowed position as the respective ends 2*a,* 3*a* of the aligned prong pairs 2', 3' are brought into contact with each other. After the hinge plates have snapped into their outwardly bowed position, the body of the actuator portion is freely seated inside the housing at about a 40–50 degree attitude as shown in FIG. 7. By "freely seated" we mean that it is not uncommon to find some clearance in the actuating lever when it occupies this position.

With the actuating lever in the 40–50 degree position, the prong pair 2', 3' are closed. Although in this position they are closed together relatively tightly, there is nevertheless some danger that the hinge plates may be inadvertently jarred back to their open or inwardly bowed position should the binder be accidently dropped. There is also some danger that the weight of the loose-leaf sheets held on the closed prong pairs may be sufficient to pry them slightly apart or possibly cause the hinge plates to snap open. The latter possibility becomes more likely when the binder is stored in inverted position with the loose-leaf sheets hanging from the prongs.

Figure 7A:
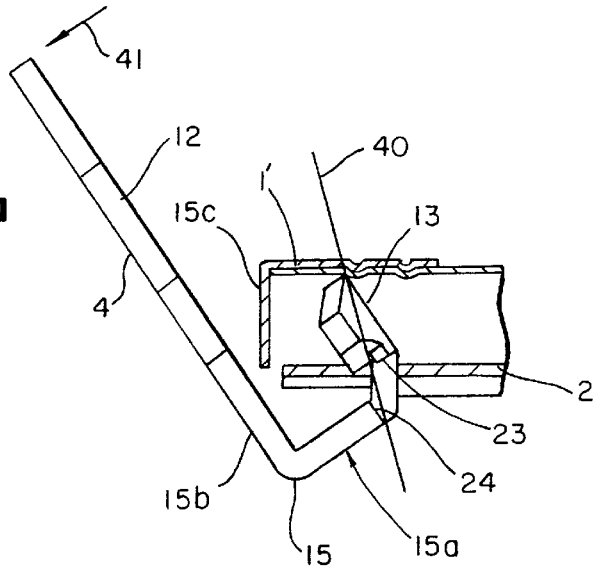

To prevent such accidental opening of the prongs and consequent loss of loose-leaf sheets from the binder, the prongs may be locked in their closed position. Locking is accomplished simply by moving the trigger 12 inwardly through a sufficient angle beyond the 40–50 degree position as shown in FIG.7 toward the center position shown in FIG. 7*b* into, say, the position shown in FIG. 7*c*. Referring to FIG. 7*c,* in this wedged-in position the major portion 16*a* of the upper surface 16 of body 13 is in tight surface-to-surface engagement with the under-surface of the housing and shell, the remaining or minor portion 16*b* of upper surface 16 contacting with relatively slight pressure the under-surface of housing 1, while the lugs 23 are put in tight engagement with the hinge plates. The hinge plates are thereby secured in their outwardly bowed position, and thus the prong pairs 2', 3' are locked together. As shown in FIG. 7*a,* an imaginary line (e.g. line 40) interconnecting any point of contact between the lugs 24 and hinge plates and any point of contact between upper edge 16 of body 13 an the under-surface of housing 1 extends at an upwardly inclined attitude in a direction (indicated by arrow 41) extending longitudinally outward relative to housing 1. In other words, any point of contact between the major portion 16*a* of upper surface 16 of body 13 and the housing 1 lies longitudinally outward of any point of contact between lugs 24 and outwardly bowed hinge plates 2, 3.

Figure 7B:
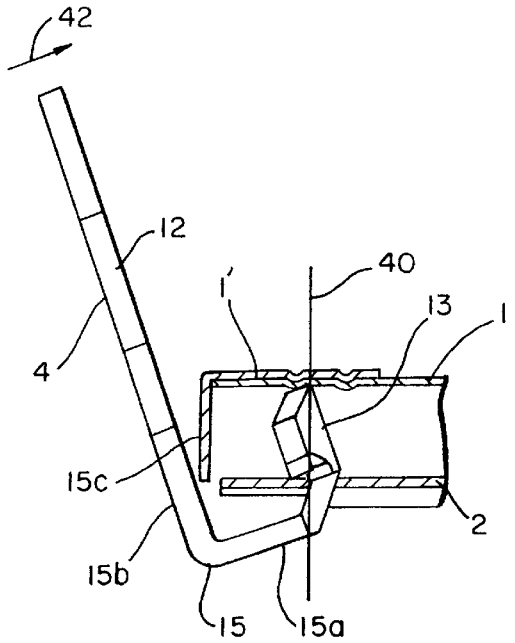
Figure 7C:
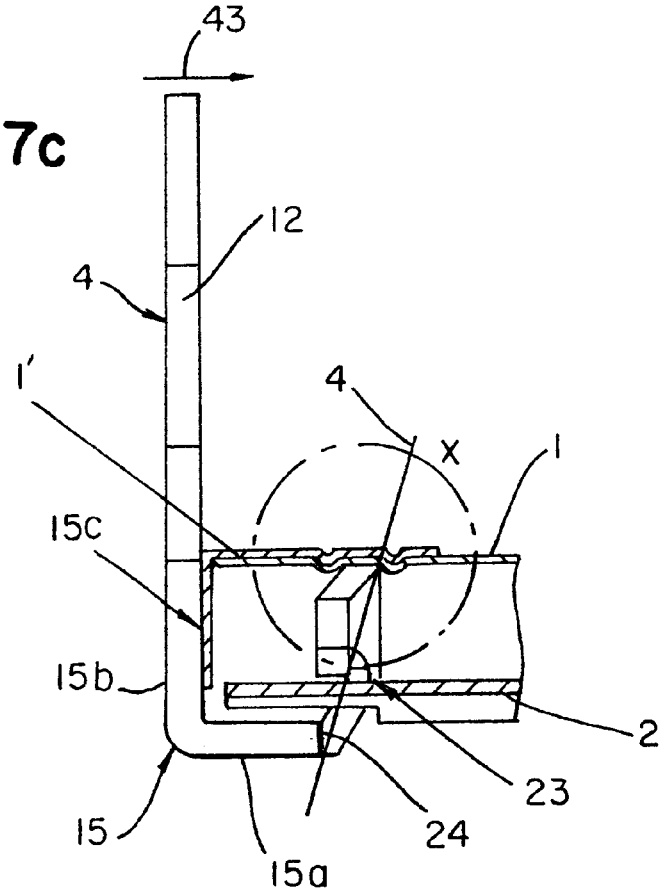
Figure 7D:
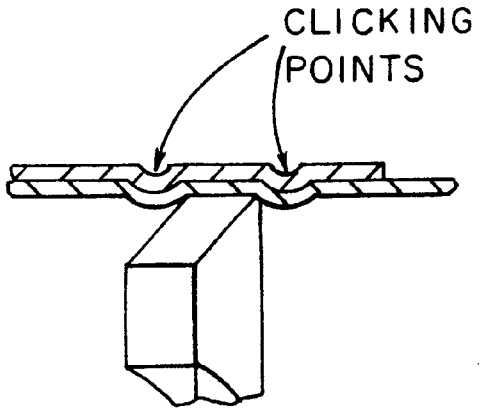

With the lever in the position shown in FIG. 7*a* or with the lever in any angular position between that shown in FIG. 7*a* and the center position shown in FIG. 7*b,* the imaginary line 40 referred to above lies at an upwardly inclined attitude extending outwardly of the housing. Although the aligned prong pairs are "locked" together when the lever is disposed at any of these angular positions, there exists a possibility that the lever could be accidently dislodged in which event the wedged-in body 13 of the lever would fall back to the 40–50 degree position mentioned earlier on. And, if the force causing such accidental dislodgement was great enough, it is possible that the lever could be moved back into the horizontal position described above and completely open up the prongs.

Figure 5:
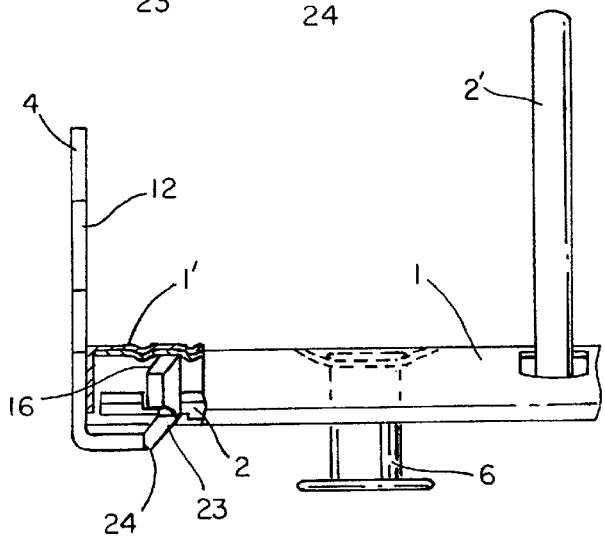
FIG. 5 is a side elevated view of the binder mechanism shown in FIG. 1 partially broken away to show the actuating lever in its locked position.
Figure 5A:
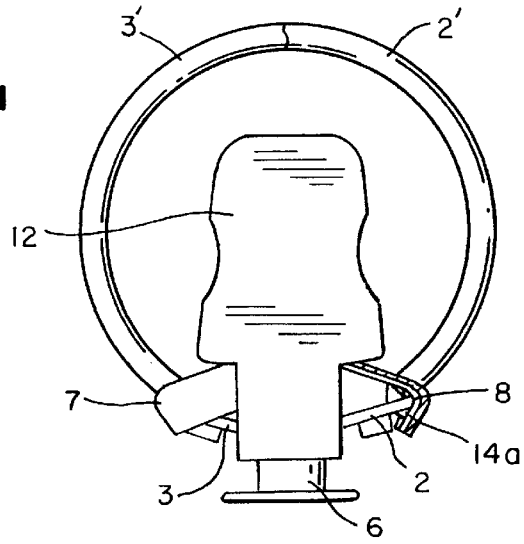
FIG. 5*a* is an end view, partially broken away, of the mechanism shown in FIG. 5.

According to this invention, accidental dislodgement of the body 13 from its wedged-in position between the hinge plates and housing can be effectively prevented by simply forcing the lever inwardly in the direction of arrow 42 past the center position shown in FIG. 7*b* and into the "past center" position shown in FIGS. 5, 5*a* and 7*c*.

In the center position shown in FIG. 7*b* it will be seen the imaginary line 40 extends in a direction perpendicular to the housing. In other words, any point of contact between the major portion 16*a* of upper surface of body 13 and the housing lies directly above or over any point of contact between lugs 23 and outwardly bowed hinge plates 2, 3. It will be recognized that maximum compressive stress is exerted on body 13 at the center position; this stress being somewhat less on either side of the center position. Therefore a relatively high force is required to be applied to the lever to move the body 13 through the center position. In other words, a relatively large force is required to move the lever from the past-center position back through center into a pre-center position. It must be noted that distortion or outward flaring of the end portion of the housing occurs as the body is moved through its range of wedged-in positions, the greatest distortion being at the center position. In order to prevent excessive distortion at the center, which would lead to loosening of the lock, the housing at the ends are reinforced by means of curled shells 1'. The form of the shell follows the profile of the housing closely. This distortion or outward flaring of the end portion of the housing is shown in the drawings but is enlarged beyond actual proportions for purposes of illustration.

In the "past center" position shown in FIG. 7*c,* the imaginary line 40 lies at an upwardly inclined attitude in a direction (indicated by arrow 43) extending longitudinally inward relative to the housing. In other words, any point of contact between the major portion 16*a* of upper surface 16 of body 13 and housing 1 lies longitudinally inward of any point of contact between lugs 23 and the outwardly bowed hinge plates 2, 3.

With the lever in the past-center position shown in FIG. 7*c,* the trigger 12 is disposed at the 90 degree position and the section 15*b* of retaining member 15 is disposed in engagement with seating surface 15*c* on housing 1. The lever is thereby prevented from being inwardly pivoted further by an accidently applied force in the direction of arrow 43 into a position where the body 13 would cease to be wedged between the housing and outwardly bowed hinged plates. Furthermore, if body 13 is so much beyond the center position a relatively large force would be required to move the body 13 back through the center position and out of wedged-in relationship between the hinge plates and the housing. Except by deliberate movement of the trigger 12 back through the center position and the 40–50 degree position and into the horizontal position to open the prongs, it is extremely unlikely that such a force would be accidentally applied during normal usage or even during moderate abnormal use as, for example by dropping the binder or by suspending a relatively heavy load of loose-leaf sheets from the closed prongs. Effectively, therefore, in the past-center position of the wedged-in body 13 the lever is safely locked against accidental release to a much greater degree than would be provided by positioning the body 13 in the center position or any ante-center position. This safety feature renders a loose-leaf ring binder constructed according to the present invention extremely valuable and advantageous as compared with other known constructions including, in particular, the construction shown in previously mentioned U.S. Pat. No. 3,098,490.

During movement of the lever through the range of angular positions where body 13 is wedged between the housing and outwardly bowed hinge plates, the fulcrum points for the lever are defined by the points of contact between lugs 24 and hinge plates 2, 3. As mentioned previously the lugs are bent relative to body 13 of the lever actuating portion. This construction achieves the proper positioning of the contact points between upper surface 16 of body 13 and housing 1 relative to the contact points between lugs 24 and hinge plates 2, 3 as previously discussed to provide the unique and novel "past center" safety lock feature in a ring binder constructed according to this invention.

To open the prongs, the lock is first released by moving the trigger back to its loosely seated 40–50 degree position. Then, the triggers at each end of the housing are pressed into the horizontal position. Such movement causes the lifting element 19 to be pivoted into engagement with the underside of the hinge plates 2, 3 thereby moving them through the coplanar position and into the inwardly bowed position in the same manner and with the same motion as described above in connection with closing the prongs by moving the hinge plates from the inwardly bowed position to the outwardly bowed position. During movement of the trigger 12 from the 40–50 degree position to the horizontal position, the lugs 24 disengage hinge plates 2,3 and the lever is pivoted about fulcrum points defined by the points of engagement between comer 14*b* joining legs 14 with the lower edge 17 of body 13 and the notches 18 in the hinge plates. The clearance in the lever at the 40–50 degree position is accounted for by the shifting of the lever from the fulcrum points defined by the points of engagement between lugs 24 and hinge plates 2, 3 to the fulcrum points defined by the points of engagement between corners 14*b* and the hinge plates 2, 3.

Since the invention is subject to modifications and variations, it is intended that the foregoing description and the accompanying drawings shall be interpreted as only illustrative of the invention defined by the following claims.

I claim:

1. In a loose-leaf binding mechanism comprising a resilient housing containing a pair of hinge plates having openings defining an aperture at either end, each having at least one prong projecting externally of the housing with each prong on one hinge plate being positioned in alignment with a prong on the other hinge plate, and an actuator lever pivotally mounted on the hinge plates and operable through an arcuate path to move the hinge plates and thus open and close the prongs, wherein the lever comprises a trigger, a body portion parallel to and offset from the trigger, and a neck portion interconnecting the trigger and the body portion, the improvement wherein said neck portion extends between a bottom edge of the trigger and a bottom edge of the body portion, below said hinge plates, and the body portion has a pair of legs which pivot on said plates.

2. The mechanism of claim 1, further comprising at least one short auxiliary shell casing, at an end of the ring binder mechanism, for reinforcing the housing to provide extra stiffness to increase the locking force and thereby reduce accidental opening of the locking mechanism.

3. The mechanism of claim 2, wherein the auxiliary shell casing comprises an end wall covering an end of the resilient housing.

* * * * *